United States Patent [19]

Ott et al.

[11] Patent Number: 4,508,599

[45] Date of Patent: Apr. 2, 1985

[54] METHOD AND APPARATUS FOR REGENERATION OF A COPPER-CONTAINING ETCHING SOLUTION

[76] Inventors: Rudi Ott, Markgroningen; Heribert Reith, Stuttgart, both of Fed. Rep. of Germany

[21] Appl. No.: 575,043

[22] Filed: Jan. 30, 1984

[30] Foreign Application Priority Data

Feb. 3, 1983 [DE] Fed. Rep. of Germany ..... 3303594

[51] Int. Cl.[3] ..... C25C 1/12

[52] U.S. Cl. ..... 204/10; 204/107; 204/130

[58] Field of Search ..... 204/130, 107, 10, 12–13

[56] References Cited

U.S. PATENT DOCUMENTS 1,959,376 5/1934 Lucas ..... 204/10

4,269,678 5/1981 Faul et al. ..... 204/130

FOREIGN PATENT DOCUMENTS 548051 3/1975 U.S.S.R. ..... 204/130

*Primary Examiner*—R. L. Andrews

[57] ABSTRACT

A method and apparatus for the regeneration of a copper-containing etching solution which contains copper (II) chloride as well as alkali chloride as a sequestering agent, wherein the cathode is operated at a current density of 40–400 A/dm$^2$ and the anode is operated at a current density of 1–100 A/dm$^2$. Copper forms at the cathode as a powdered slurry while chlorine forms at the anode which oxidizes copper (I) chloride to copper (II) chloride. With this method one can process etching solutions which contain not only copper but also base metals including zinc from etching brass or tombac, and obtain a powdered mixture of copper and base metal. The apparatus features a rotating disk-shaped cathode from whose outer face the metal powder is stripped by a scraper.

12 Claims, 2 Drawing Figures

METHOD AND APPARATUS FOR REGENERATION OF A COPPER-CONTAINING ETCHING SOLUTION

FIELD OF THE INVENTION

The present invention relates to methods of regenerating a copper containing etching solution and apparatus for performing the same. More specifically, the present invention is directed to methods of regenerating copper-containing etching solutions which are used to etch printed circuit boards.

BACKGROUND OF THE INVENTION

It is known from German Patent Disclosure Document DE-OS No. 29 42 504 to etch copper with a copper (II) chloride-containing etching solution which contains as a sequestering agent an alkali chloride, particularly potassium chloride. Such etching solutions are especially suited for use in fabrication of printed circuit boards. Copper (II) chloride etching solutions containing alkali chloride are preferred over conventional solutions containing hydrochloric acid as a sequestering agent because they have a faster etching speed. Furthermore, such solutions eliminate the problems of handling hydrochloric acid which pollutes the air and causes corrosion damage to the processing equipment. Additionally, such solutions can be used in automated spray machines as well as in an immersion process integrated in an automatic galvanizing machine.

Conventional regeneration of copper (II) chloride etching solutions containing alkali chloride is performed by introducing air into the etching solution, which eliminates the need to charge the solution with hydrogen peroxide. However, oxidation by air requires filtration of the resulting copper (II) hydroxide. Filtration is required to obtain metallic copper. The filtration process includes dissolving the copper (II) hydroxide in acid and then treating with electrolytes. However, the filtration method does not efficiently remove the copper hydroxide necessitating the use of additional procedures to achieve regeneration. Thus, the above conventional procedure does not lend itself to a closed system for regenerating copper containing etching solutions.

It is therefore an object of the invention to provide a method of regenerating copper from a copper (II) choride etching solution containing an alkali chloride as a sequestering agent.

It is another object of the invention to provide a method of regenerating copper from said etching solution which removes only the etched off metal from the etching solution.

It is a further object of the invention to provide an apparatus for regenerating said copper (II) chloride etching solution.

SUMMARY OF THE INVENTION

The present invention is directed to a method and apparatus for regenerating metallic copper from a copper (II) chloride etching solution containing an alkali chloride as a sequestering agent wherein the etching solution is passed through a regeneration apparatus having an anode and cathode to which a D.C. voltage is applied to provide a cathodic current density of 40–400 $A/dm^2$ preferably 80 to 120 $A/dm^2$ and an anodic current density of 1–100 $A/dm^2$ preferably 35 to 70 $A/dm^2$. Chlorine is formed at the anode which oxidizes copper (I) chloride to copper (II) chloride. Metallic copper is separated out from the solution at the cathode in the form of a fine crystalline slurry.

In accordance with the present invention the spent etching solution which is to be regenerated contains copper in the form of copper (I) chloride and copper (II) chloride. The chloride ions in the spent etching solution are oxidized at the anode to produce chlorine which reacts with copper (I) chloride to form copper (II) chloride.

etching process: $Cu+CuCl_2 \rightarrow 2CuCl$ regeneration process steps: $2CuCl+Cl_2 \rightarrow 2CuCl_2$ anode: $2Cl^- \rightarrow Cl_2+2e^-$ cathode: $CuCl_2+2e^- \rightarrow Cu+2Cl^-$ The chloride ions are obtained from the reaction at the cathode wherein copper (I) chloride and copper (II) chloride is reduced to metallic copper. The metallic copper is formed on the cathode as a powered slurry and removed therefrom for further processing. The pH of the spent etching solution is preferably maintained between 1.0 and 3.0, most preferably between 1.5 and 2.5.

The present method is superior to prior art systems using a copper (II) chloride/alkali chloride etching solution in that only etched-off metal is removed from the spent etching solution by maintaining the copper (I)/copper (II) redox potential at a substantially constant value.

The electrochemical process of the invention is controlled by testing the level of copper (I) ions with the aid of the redox potential. The level of copper (I) ions is increased by etching copper, the redox potential decreases below 390 mV. Below 390 mV the current is shutting on and the electrochemical process is running:

(a) Chlorine formed at the anode oxidites the copper (I) chloride to copper (II) chloride until the switch point of 390 mV is reached (b) the etched copper is separated out of the solution at the cathode in the form of a time slurry.

The present invention also eliminates the use of well known additives and the regeneration apparatus can be constructed in a compact manner and is therefore very well adapted for use in an assembly line.

The present invention is particularly advantageous for the etching of alloys which, besides copper, contain base metals such as zinc. In this case, the regeneration apparatus is provided with a cathodic current density between 100 and 400 $A/dm^2$ and the solution is kept at a pH of at least 1.0 and the copper and base metals (e.g., zinc) are separated out in the form of a powdered slurry.

The apparatus of the present invention can be built in a compact unit and the metallic powder which is stripped from the cathode can be continuously removed from the system.

BRIEF DESCRIPTION OF THE DRAWINGS

An embodiment of the invention is shown in the drawing and explained in the following description.

DETAILED DESCRIPTION OF THE INVENTION

Figure 2:
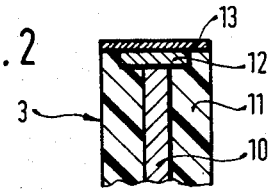
FIG. 2 is a cross-section through the disk-shaped cathode.

The regeneration apparatus comprises a container 1 made of plastic or insulated metal, with an inlet 14 and an outlet 15 on the etching apparatus, as well as connections 7 and 8 for connecting the container 1 to the circulation pump 16. The container 1 houses a substantially circular disk-shaped cathode 3 made of copper fastened on a copper spindle 2 which serves to conduct current to the cathode. As shown in FIG. 2, cathode 3 comprises copper disk 10 having on its periphery a copper ring 12, each of which are surrounded by PVC (Polyvinylchloride) insulation 11. A hoop 13, composed of titanium is drawn around the uninsulated outer edge face as a contact material for the etching solution. Copper cannot be used as the contact material because it dissolves in the etching solution.

Figure 1:
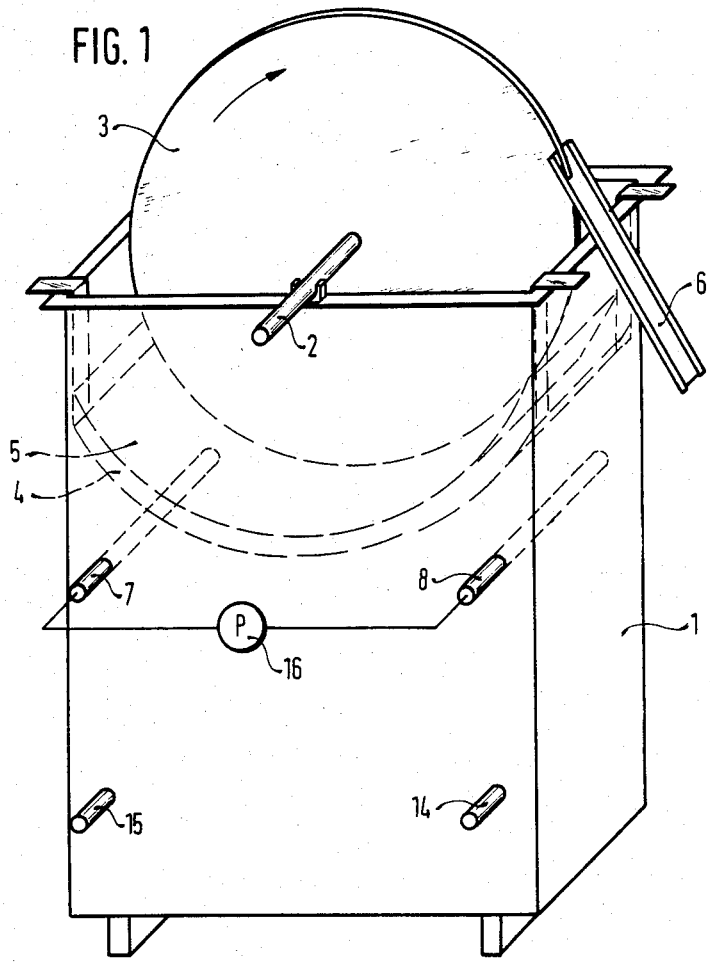
FIG. 1 is a perspective view of the regeneration apparatus.

The copper spindle 2 is, as shown in FIG. 1, rotatably supported on the container rim. The driving of the disk is accomplished by means of an electrically insulating plastic gear (not shown) fastened to the copper spindle, while the current supply to the cathode surface is accomplished by carbon brushes (not shown) against the rotating copper spindle and thence through the insulated copper disk to the hoop 13.

The anode 4 is disposed parallel to and slightly spaced from the outer edge of the cathode 3. The anode contains titanium, niobium or tantalum covered with platinum, iridium or non-stoichiometric platinum group metal oxide compounds. The compounds used for the covering can be in the form of a solid material or as expanded metal.

Between the cover cathode 3 and the anode 4 is a porous partition 5 made of non-conductive material such as a plastic material (e.g., polypropylene or polyethylene). The partition (diaphragm) serves to shield the cathode 3 from the turbulence caused by the circulation pump without inhibiting the electrolytic exchange. The partition has therefore no diaphragm function, but serves merely as a flow dampener A stripper or scraper 6 is fastened, in loose contact with the outer edge of the cathode 3, on the container rim. During the rotation movement of the cathode 3, a copper slurry is stripped from the cathode and rinsed with the help of a water spray into a receiving container (not shown). The rinsing spray water is recycled. Upon reaching a predetermined amount of copper slurry and a specific salt concentration in the rinse water, the contents of the receiving container are subjected to solid/liquid separation such as with the use of decanters and filters.

The etching solution to be regenerated is conducted from the etching apparatus (not shown) through the inlet 14 of the regeneration apparatus and flows back again through the outlet 15 to the etching apparatus.

The metallic copper in the form of a very fine crystalline copper powdered slurry on the cathode is produced by providing a current flow under high current density conditions. As a result, copper ions are reduced at the cathode to metallic copper. At the anode, chloride ions are oxidized to form chlorine, which readily dissolves in water and is quickly distributed through the entire container of the regeneration apparatus by the generation of a strong flow of electrolyte. The thus produced chlorine oxidizes copper (I) chloride of the spent etching solution to form the regenerated etching solution containing copper (II) chloride. To prevent the over production of chlorine, the present electrochemical process is controlled by monitoring the level of copper (I) ions. This is accomplished by maintaining the redox potential of the copper (I)-copper (II) reaction at a substantially constant value and shutting off the current at a limit of about 390 mV.

The following are examples of the method of regenerating a spent etching solution used in spray etching, the spent etching solution has the following parameters:

EXAMPLE 1

Cu: 50 g/l in the form of Cu(II) chloride
KCl: 150 g/l
Redox potential: +390 mV; switching point on/off for the electrochemical regeneration: ≧390 mV: off, <390 mV: on
Temperature: 45° C. (113° F.)
pH value: 2.3
cathodic current density: 100 A/dm$^2$
anodic current density: 35 A/dm$^2$ The regeneration apparatus, as it is used here, has a volume of 210 l, the cathode 3 is disk shaped having a diameter of 500 mm with a submerged cathode surface of 2 dm$^2$. The anode surface measures 15 dm$^2$. The circulation pump 16 pumps the entire container volume around 25 times per hour. The current efficiency was about 1.0 g/Ah. Copper in the form of a powdered slurry was thereby removed from the cathode.

In the following example, an etching solution containing etched-off zinc as well as copper was regenerated:

EXAMPLE 2

Cu: 50 g/l
KCl: 100 g/l
Zn: 20 g/l
Temperature: 22° C.
pH value: 1.5
redox potential: +390 mV
cathodic current density: 300 A/dm$^2$
anodic current density: 70 A/dm$^2$ The metal powder obtained from the cathode consisted of 58% copper and 42% zinc. This composition of the metal powder is independent of the etching solution concentration.

What we claim is:

1. A method of regenerating a copper containing etching solution comprising copper (II) chloride and an alkali chloride as a sequestering agent from a spent etching solution containing copper (I) chloride comprising:

(a) passing said spent etching solution through an electrolytic reaction vessel containing an anode and cathode, said anode and cathode being separated by a porous diaphragm;
(b) operating said cathode at a current density of 40–400 A/dm$^2$ and said anode at current density of 1–100 A/dm$^2$, whereby chlorine is produced at said anode and metallic copper is deposited on said cathode, said chlorine reacting with said copper (I) chloride to form copper (II) chloride; and
(c) removing said deposited metallic copper from said cathode.

2. The method of claim 1 wherein the current density of the cathode is between 80 and 120 A/dm$^2$.

3. The method of claim 1 wherein the current density of the anode is between 35 and 70 A/dm$^2$.

4. The method of claim 1 further comprising maintaining the redox potential of the reaction of copper (I) to copper (II) at below 390 mV.

5. The method of claim 1 further comprising maintaining the pH of said spent etching solution at at least 1.0.

6. The method of claim 5 wherein the pH of the spent etching solution is between 1.0 and 3.0.

7. The method of claim 1 wherein said spent etching solution further comprises at least one base metal, said method further comprising operating said cathode at a current density of 100–400 $A/dm^2$ and maintaining said spent etching solution at a pH of at least 1.0.

8. The method of claim 7 wherein said base metal is zinc.

9. The method of claim 1 wherein the spent etching solution is passed smoothly in the vicinity of said cathode and turbulently in the vicinity of said anode.

10. The method of claim 1 wherein:

the current density of the cathode is between 80 and 120 $A/dm^2$;

the current density of the anode is between 35 and 70 $A/dm^2$;

the redox potential of the reaction of copper (I) to copper (II) is maintained at below 390 mV; and the pH of the spent etching solution is between 1.0 and 3.0.

11. The method of claim 10 wherein the spent etching solution is passed smoothly in the vicinity of said cathode and turbulently in the vicinity of said anode.

12. The method of claim 11 wherein said spent etching solution also contains zinc.

* * * * *

UNITED STATES PATENT AND TRADEMARK OFFICE

CERTIFICATE OF CORRECTION

PATENT NO. : 4,508,599

DATED : April 2, 1985

INVENTOR(S) : Rudi OTT, et al

It is certified that error appears in the above-identified patent and that said Letters Patent is hereby corrected as shown below:

Column 3, line 36, delete "has therefore no diaphragm func-";
line 37, delete all of the subject matter on this line and insert --therefore does not have the common diaphragm function of inhibiting exchange of electrolyte. It functions merely to dampen the flow of electrolyte.--;

Column 4, line 53, after "a porous" delete "diaphragm" and replace it with --partition--.

Signed and Sealed this

*Fourteenth* Day of *January 1986*

[SEAL]

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,508,599

DATED : April 2, 1985

INVENTOR(S) : Rudi OTT, et al

It is certified that error appears in the above-identified patent and that said Letters Patent is hereby corrected as shown below:

On the initial page of the patent, in the heading thereof, insert the Assignment data as follows:

--Assignee: Robert Bosch GmbH, Stuttgart, Fed. Rep. of Germany--.

Signed and Sealed this

*Twenty-seventh* Day of *May 1986*

[SEAL]

*Attest:*

DONALD J. QUIGG

*Attesting Officer*

*Commissioner of Patents and Trademarks*